United States Patent [19]

Singleman et al.

[11] Patent Number: 4,706,961

[45] Date of Patent: Nov. 17, 1987

[54] GAME OF CHANCE

[76] Inventors: Alfred H. Singleman, 7000 Lindbergh St., Philadelphia, Pa. 15153; Alfred H. Singleman, Jr., 425 Campbell Rd., Schenectady, N.Y. 12303; Erick R. Singleman, 248 Catherine St., Albany, N.Y. 12209

[21] Appl. No.: 881,000

[22] Filed: Jul. 1, 1986

[51] Int. Cl.[4] ..... A63F 1/04

[52] U.S. Cl. ..... 273/274; 273/271; 273/292

[58] Field of Search ..... 273/274, 143 R, 292, 273/271

[56] References Cited

FOREIGN PATENT DOCUMENTS 2083935 3/1982 United Kingdom ..... 273/274

*Primary Examiner*—Anton O. Oechsle

*Attorney, Agent, or Firm*—Schmeiser, Morelle & Watts

[57] ABSTRACT

In a wagering type of game each player receives a game board having a plurality of designated areas in alignment with each other. A plurality of cards each having an identifying indicia thereon and containing groups of subsets correspond to a legend which identifies a certain point value for each different type of subset. Each player bets a certain amount which entitles that player to a number of cards which are placed on the designated areas. Cards on shaded areas may be exchanged once for a card in either a horizontal, vertical or diagonal alignment with said shaded area. Also depending upon the amount that a player bets he may be entitled to receive points for aligning indicia to form subsets along horizontal, vertical or diagonal pathways, or any combination thereof.

4 Claims, 1 Drawing Figure

POINTS
300 JACKPOT
400 JACKPOT
500 JACKPOT
MIXED
10
12
14
16
18
20
22
24
26
28
30
32
34
36

GAME OF CHANCE

FIELD OF THE INVENTION

Generally, this invention relates to games and more specifically to games of chance such as those which relate to betting or wagering.

BACKGROUND OF THE INVENTION

There are presently available numerous games which relate to betting and wagering. Such games often require the player to make an initial bet after which either cards are dealt or else dice are rolled in order to determine if the player has won. In some situations the bets may be increased as the game progresses.

In some games the player may turn in a certain number of cards and receive additional cards in order to make the desired matching combinations. However, as with most games once the replacement cards are dealt hands no longer change and the player with the highest value simply wins the chips wagered.

It was an intimate familiarity with games such as those described above and their shortcomings which led us to the development of the subject invention.

It is an object of this invention to provide a new and improved game of chance wherein the amount wagered is directly proportional to the number of winning opportunities which the player will have;

Another object of this invention is to provide a new and improved game of chance wherein the player has the opportunity to analyze the gameboard and make beneficial substitutions;

Another object of this invention is to provide a new and useful wagering game wherein a plurality of winning hands may be obtained and said hands may utilize common cards;

Another object of this invention is to provide a new and improved game of chance wherein each player has various playing options before the cards are dealt and may choose different options at different points in the game.

These and other objects will be disclosed in the subject disclosure and further objects may be identified and appreciated through the use of the subject invention.

SUMMARY OF THE INVENTION

It has been found that the objects of this invention may be readily accomplished through the use of a plurality of playing boards each having designated areas for the placement of cards. Each card has an identifying indicia thereon and said cards contain card subsets wherein the indicia is related so as to enable the player to match the related indicia to accomplish certain combinations in accordance with a scoring or evaluation chart. The playing boards have groups of designated areas upon which cards are placed either face up of face down depending upon the markings in the various designated areas. The player by wagering greater sums may become entitled to receive a greater number of cards. Cards which are dealt face down may be used as substitutes for other cards on the playing board whereby vertical, horizontal and diagonal card alignments may be created in order to match combinations on the evaluation chart.

It has been found that the features of this invention provide a remarkably enjoyable and easy to play wagering type game. In addition, each player is faced with certain strategic choices as to how to play the game and how to realign the cards in order to obtain the most beneficial combinations. In these ways the subject invention also provides a most challenging and competitive wagering game.

DETAILED DESCRIPTION OF THE INVENTION

Figure 1:
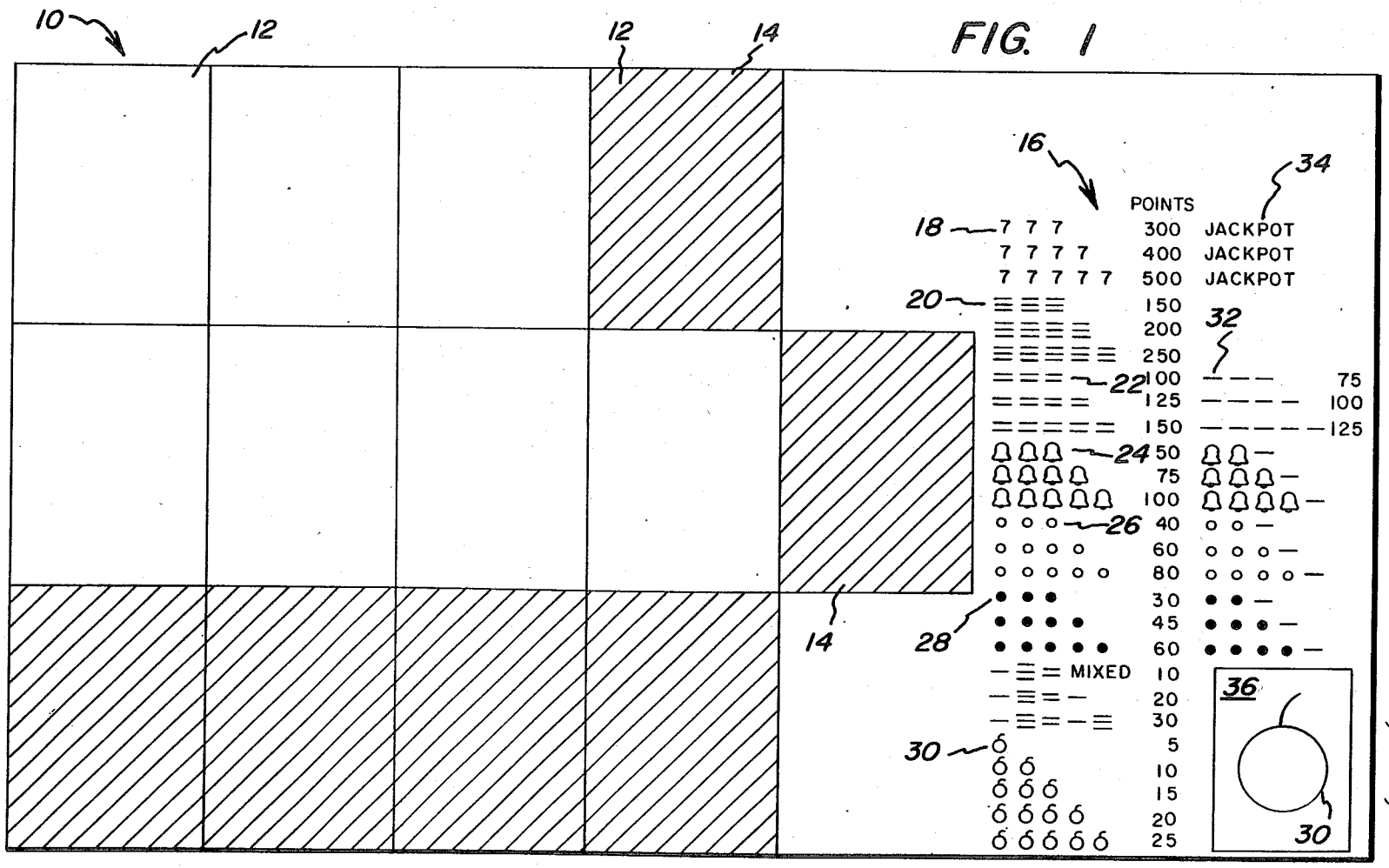
FIG. 1 is a plan view of the gameboard.

Each player in the game receives a game board as shown in FIG. 1 and generally designated as 10. A portion of the game board is divided into a plurality of rectangular designated areas 12. The designated areas are aligned with respect to each other such that each designated area is in a horizontal, vertical, or diagonal alignment with at least 3 other designated areas. These designated areas 12 include a number of shaded areas 14. In my preferred embodiment there are 4 designated areas in the first horizontal line. From left to right the first 3 are clear and the fourth being shaded; the areas immediately beneath the first line consist of 5 designated areas the first 4 of which are clear and the fifth being shaded, also when moving from left to right; the final line of areas which lie immediately beneath the second line consists of 4 shaded areas 14.

Immediately to the right of the designated areas is a legend 16 which lists various combinations of indicia and indicates a point value for each combination. In my preferred embodiment the indicia include 7s shown at number 18, 3 bars 20, 2 bars 22, bells 24, oranges 26, plums 28, cherries 30, and single bars 32. Points are also given for obtaining certain mixed indicia as shown in the legend 16. For example, two cherries and a single bar equal 30 points whereas 4 oranges and a single bar equals 80 points. In addition to the point values given for each combination the obtaining of 3, 4 or 5 sevens are designated as jackpot combinations as shown at 34.

The game also includes two decks of cards which are generally a rectangular shape and sized to fit within the designated areas. These cards 36, such as the one shown in the lower right hand corner of game board 10 have an indicia on one side. For example, card 36 which is shown has a cherry 30. Thus, each deck includes a plurality of subsets which correspond to the various combinations shown in the legend 16. In my preferred embodiment the first deck has 5 cards with sevens imprinted thereon, 6 cards with 3 bars, 6 cards with 2 bars, 6 cards with 1 bar, 7 cards with 1 bell, 7 cards with 1 orange, 8 cards with 1 plum, and 9 cards with 1 cherry. In the second deck the odds of getting a winning combination for either of the 3 bar groupings is increased. However, there is also a greater chance of receiving no points. This second deck has 5 cards with sevens imprinted thereon, 7 cards with 3 bars, 9 cards with 2 bars, 10 cards with 1 bar. In addition there are 24 cards in the second deck that have a null marking and thus cannot be used to make any combination.

At the beginning of the game each player is given a predetermined number of chips (not shown). Prior to each hand the players will put a predetermined number of chips into a jackpot. The chips in the jackpot can only be won if a player gets either 3, 4 or 5 sevens aligned properly. If that is not accomplished the jackpot goes to the player having the most points at the end of the game. Also at the beginning of each hand each player decides how many cards he wishes to be dealt and which alignments he wishes to qualify for in order to obtain the predetermined subsets indicated in the legend. Depending upon each player's decision that player puts a certain number of chips into a second pot which is distributed at the end of each hand. For example, if a player wishes to only receive 4 cards across the top line he would put a certain predetermined amount into the second pot. However, if the player chose to have all the designated areas filled with cards and to be entitled to make subsets on vertical, horizontal and diagonal alignments that player would have to place a much larger number of chips into the second pot. This feature allows each player to partake in a betting type of arrangement and thus adds strategy to the game. In addition, the cards placed on the shaded areas may be exchanged once for any other card in either a diagonal, horizontal or vertical alignment with that shaded area. This significantly adds to the strategy in the game and challenges the player to devise the most beneficial groups of subsets. It should be appreciated that although a card on each shaded area may only be exchanged once it is possible to use exchange option of the other shaded areas to move a particularly beneficial card to its desired location on the game board. The person who succeeds in obtaining the highest number of points for each hand wins the chips which have been placed into the second pot.

It should be appreciated that numerous variations can be made in this game without departing from the intended invention. For example, the number of subsets in each deck can be varied or if preferable only one deck may be used. In addition, it is possible during the play of the game to rotate the deal amongst the players and then empower the dealer with the authority to decide the number of cards each player will play and the types of alignment which are allowed. This will eliminate the determination by each player as to how many chips should be put into the second pot but will shift the strategy as each dealer determines which type will be to his best benefit. Another variation would be to give the second pot which is won at the end of each hand to that player who obtains the highest valued single combination of indicia instead of paying the contents to the person with the highest total points. Still another variation would be to deal the cards face down on the designated areas marked by shading. The player would then have to put more chips into the second pot after the deal to be entitled to use the face down card.

While many variations on this general theme may be accomplished it is intended that the scope of this invention be limited only by the appended claims.

What is claimed:

1. a game comprising:

a set of cards having identifying indicia thereon, said indicia comprising a plurality of subsets;

a legend that relates various combinations of card indicia to value indicia whereby a player may calculate the relative worth of a playing hand;

a plurality of playing boards, one for each player, each of said boards having a plurality of designated areas, each area adapted to receive a. card, said designated areas aligned in groups of three or more and each of said groups positioned relative to the other groups such that the designated areas in the group each align with designated areas in the other groups, whereby players might strive to conform any of said subsets to such alignments, a pre-determined number of designated areas having markings for indicating that cards placed on such areas may be exchanged with a card aligned vertically, horizontally, or diagonally to said marked areas, there being at least 3 groups, each of which contains at least 3 designated areas, said groups being arranged such that each designated area is included in a horizontal and vertical row having at least 3 designated areas; and at least one marked designated area on each board which is separate from the groups.

2. a game of chance comprising the following steps;

supplying each player with a pre-determined number of playing chips;

providing each player with a playing board, each of said boards having a plurality of designated areas, each adapted to receive a card, said designated areas being aligned in groups of three or more, said groups being positioned such that each designated area aligns with designated areas in the other groups, a pre-determined number of said areas having markings thereon,;

dealing each player cards having identifying indicia on one side, said cards further comprising subsets having related indicia thereon, said cards being placed one each on the designated areas, the number of cards to be dealt to each player to be determined by the number of playing chips a player bets; and using the cards in the marked designated areas as replacements for other cards in alignment therewith, whereby combinations of indicia may be obtained which correspond to a valuation chart whereby each player arranges the cards to obtain the most favorable alignments, and the highest value.

3. The invention of claim 2 including the following steps:

placing a predetermined number of playing chips into a jackpot at the beginning of the game; and placing additional chips into a secondary container prior to each deal, the number of chips placed into the secondary container by each player corresponding to the number of cards which the player wishes to obtain; and giving the contents of the secondary container to the player having the highest value at the end of each deal, the jackpot being paid out only upon the obtaining of certain combinations of cards with matching indicia thereon.

4. the invention of claim 3 wherein each player may add sufficient additional playing chips to the secondary container in order to have cards placed on all of the designated areas of his board and to qualify for matching combinations from the horizontal, verticle, and diagonal alignments of cards in the designated areas within the groups.

* * * * *